United States Patent [19]

Sato

[11] Patent Number: 4,538,495

[45] Date of Patent: Sep. 3, 1985

[54] TONE COLOR SETTING APPARATUS

[75] Inventor: Kunio Sato, Tokyo, Japan

[73] Assignee: Casio Computer Co., Ltd., Tokyo, Japan

[21] Appl. No.: 663,815

[22] Filed: Oct. 22, 1984

Related U.S. Application Data

[63] Continuation of Ser. No. 461,183, Jan. 26, 1983, abandoned.

[30] Foreign Application Priority Data

Feb. 4, 1982 [JP] Japan ..... 57-15654

[51] Int. Cl.[3] ..... G10H 1/06; G10H 7/00

[52] U.S. Cl. ..... 84/1.19; 84/1.11; 84/477 R; 84/478

[58] Field of Search ..... 84/1.01, 1.11, 1.12, 84/1.19–1.23, 477 R, 478

[56] References Cited

U.S. PATENT DOCUMENTS

| | | | |
|---|---|---|---|
| 3,992,969 | 11/1976 | Robinson et al. | 84/1.01 |
| 3,999,458 | 12/1976 | Suzuki | 84/1.01 |
| 4,121,204 | 10/1978 | Welch et al. . | |
| 4,157,049 | 6/1979 | Watanabe | 84/1.01 X |
| 4,283,983 | 8/1981 | Kashio | 84/1.19 |
| 4,391,176 | 7/1983 | Niinomi et al. | 84/1.19 X |
| 4,402,243 | 9/1983 | Deforeit | 84/1.01 |
| 4,416,177 | 11/1983 | Loeb | 84/1.19 |

FOREIGN PATENT DOCUMENTS

| | | |
|---|---|---|
| 0038707 | 10/1981 | European Pat. Off. . |
| 1515904 | 6/1978 | United Kingdom . |
| 2019632 | 10/1979 | United Kingdom . |
| 2050669 | 1/1981 | United Kingdom . |
| 2069740 | 8/1981 | United Kingdom . |

*Primary Examiner*—S. J. Witkowski

*Attorney, Agent, or Firm*—Frishauf, Holtz, Goodman & Woodward

[57] ABSTRACT

Musical tone color setting apparatus is arranged so that when a program/preset switch, a feet switch envelope switch and modulation switch are actuated together with a selected key of a ten-key input unit, program tone color data obtained by combining data selected from three groups of tone color data is stored in a tone color data memory. A tone color data corresponding to the program tone color data stored in the memory is later read out from a ROM, and a music sound having a tone color corresponding to the tone color data is generated from a loudspeaker in response to operation of a keyboard.

12 Claims, 11 Drawing Figures

FIG. 5A

| | 1 | 2 | 3 | 4 | 5 | 6 | 7 | 8 | 9 | 0 |
|---|---|---|---|---|---|---|---|---|---|---|
| FEET | | | | | | | | | | |
| ENV | | | | | | | | | | |
| MOD | | | | | | | | | | |
| PRESET | | | | | | | | | | |

FIG. 5B

| | 1 | 2 | 3 | 4 | 5 | 6 | 7 | 8 | 9 | 0 |
|---|---|---|---|---|---|---|---|---|---|---|
| FEET | | | | | | | | | | |
| ENV | | | | | | | | | | |
| MOD | | | | | | | | | | |

TONE COLOR SETTING APPARATUS

This application is a continuation of application Ser. No. 461,183, filed Jan. 26, 1983, and now abandoned.

BACKGROUND OF THE INVENTION

This invention relates to a tone color setting apparatus for selectively setting a tone color which is to be imparted to a musical tone generated from an electronic musical instrument.

Two typical methods are used to select one of a number of tone colors in known electronic musical instruments.

In one of the methods, about ten to twenty tone colors resembling those of natural musical instruments such as piano or organ are preset, and a desired tone color is selected by operation of a switch by the player. In this method, however, the number of preset tone colors is so small that the player can not play a piece of music with a tone rich in color.

On the other hand, a known music synthesizer enables a large number of tone colors to be set on an optional basis, but its tone color setting operation is extremely complicated, and is therefore difficult, especially for a beginner. In addition, the music synthesizer has low reproducibility of the set tone colors and it is also quite expensive.

SUMMARY OF THE INVENTION

Accordingly, an object of the invention is to provide a tone color setting apparatus for use in an electronic musical instrument which is capable of setting a large number of tone colors or tone qualities through an extremely simple operation and with a high reproducibility, and which can be manufactured relatively inexpensively.

According to the invention, a tone color setting apparatus includes tone colar data memory means comprising at least first memory means for storing a first tone color group including a plurality of tone color data and second memory means for storing a second tone color group including a plurality of tone color data different from that of said first tone color group, and tone color setting means for designating a single given tone color data from each corresponding tone color group of said at least first and second memory means, and for combining the designated tone colar data, wherein the combined tone colors set by the tone color setting means are for forming musical tones to be generated from an electronic musical instrument.

BRIEF DESCRIPTION OF THE DRAWINGS

FIGS. 5A and 5B are views showing the general constructions of a ROM and tone color data memory of FIG. 4;

DETAILED DESCRIPTION OF THE PREFERRED EMBODIMENT

Figure 1:
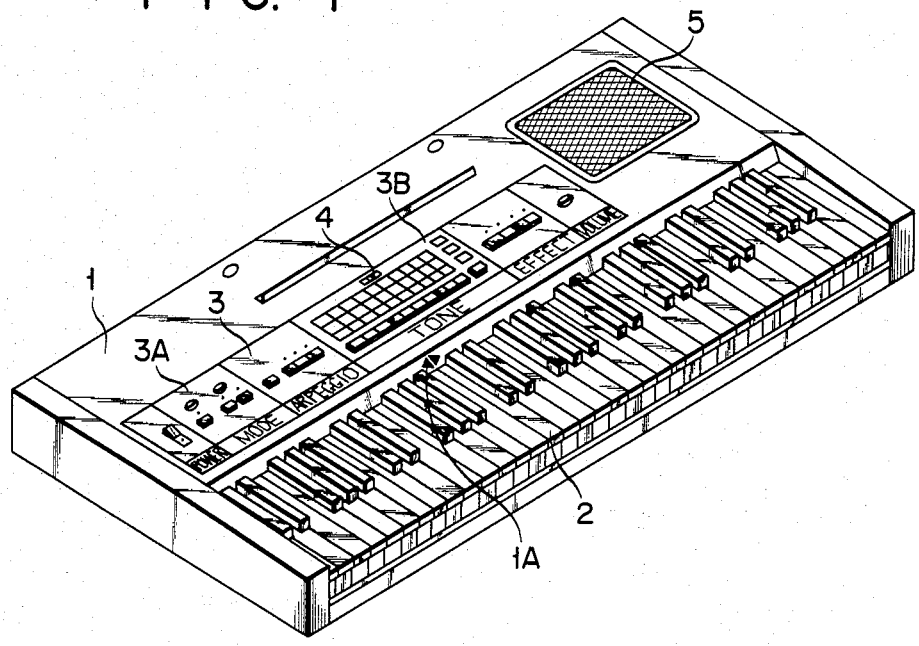
FIG. 1 is a perspective view showing the other appearance of an electronic musical instrument to which the invention is applied as an embodiment thereof.

FIG. 1 shows the outer appearance of an electronic musical instrument according to an embodiment of the invention. In FIG. 1, a case 1 of the electronic musical instrument comprises, thereon, a keyboard 2 having sixty-one performance keys, a switch section 3 having various switches, a display section 4 comprised of a light emitting diode or liquid crystal device for displaying a numeric value, notation, letter, etc. of three figures or places, and a sound generation section 5. Further, within the case 1, there are electronic circuit parts, such as an LSI (Large-Scale Integration) chip, constituting various circuits shown in FIGS. 4 and 6, as well as a speaker, etc. The keyboard 2 has keys corresponding to five octaves and can be functionally divided, through the actuation of a split switch 3A-3 as later described, into two parts from a boundary mark 1A provided on the surface of the case 1. One of the two parts is a lower keyboard corresponding to two lower octaves, and the other of the two parts is an upper keyboard corresponding to three upper octaves. This arrangement makes it possible to conduct, by the use of the lower and upper keyboards, a simultaneous performance based on different tone colors from the two split keyboards.

Figure 2:
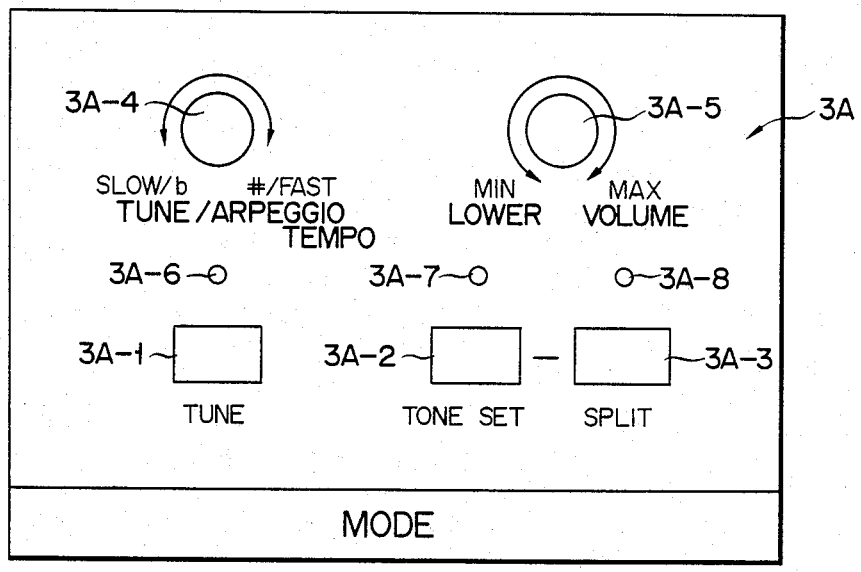
FIG. 2 is an enlarged plan view showing a mode switch section of FIG. 1.

The switch section 3 is comprised of a mode switch section 3A and a tone switch section 3B. The mode switch section 3A comprises, as shown in FIG. 2, a tuning switch 3A-1, a tone set switch 3A-2, a split switch 3A-3, a rotary switch 3A-4 and a lower volume 3A-5. The switches 3A-1 to 3A-3 are each a binary switch which, for each actuation, causes an inversion of the operation from the "on" state to the "off" state or vice versa. The tuning switch 3A-1 is a tuning mode setting switch which, at the time of its "on" operation, permits a tuning operation by actuating the rotary switch 3A-4. Further, when, at the time of the "off" operation of the tuning switch 3A-1, the rotary switch 3A-4 is subjected to rotating operaion, an arpeggio tempo is set. When they are both in "off" state, the tone set switch 3A-2 and the split switch 3A-3 permit the same tone color to be set with respect to each key of the keyboard 2 through actuation of the tone switch section 3B. Further, when the tone set switch 3A-2 is turned off and the split switch 3A-3 is kept "on", it is possible to set a tone color with respect to the upper keyboard through the actuation of the tone switch section 3B. Further, when both of the tone set switch 3A-2 and the split switch 3A-3 are kept in their "on" states, respectively, it is possible to set a tone color with respect to the lower keyboard through the actuation of the tone switch section 3B.

The lower volume 3A-5 is a switch provided to adjust the tone volume of the arpeggio performance as well as the tone volume with respect to each key of the lower keyboard. For each of switches 3A-1 to 3A-3, display units 3A-6 to 3A-8 comprised of LEDs (Light Emitting Diodes) are provided so as to be lit at the time when the corresponding switch is turned on.

The constructions of the tone switch section 3B and display section 4 now are explained in detail in connection with FIG. 3. In the Figure, a ten-key unit 3B-1, as shown, is comprised of ten keys [1] to [0]. When each of the ten keys is independently actuated, it is possible, as shown, to set ten kinds of preset tone colors such as those of pipe organ, brilliant organ, flute, etc. with respect to each key of the keyboard 2. A feet switch 3B-2, an envelope switch 3B-3 and a modulation switch 3B-4 are switches for designating three tone-color groups each containing tone colors belonging to a groups, respectively. That is, the tone color designation for the first groups is made by the use of a harmonic composing ratio, and ten kinds of tone colors are prepared on the top level or stage of a tone color data display section 3B-6. For instance, the tone color which can be set by actuation of the feet switch 3B-2 and the [1] key of the ten-key unit 3B-1 is a tone color having a harmonic composing ratio of 16'-8'-5⅓-4'-2' (16-feet, 8-feet, 5⅓-feet, 4 feet and 2-feet). In this way, it is possible to set tone colors having the illustrated harmonic composing ratios by actuations of the keys [2] to [0] and the feet switch 3B-2. The tone color designation for the second tone color group is made by the use of ten kinds of envelope data, which are prepared, as shown, on the middle stage of the tone color data display section 3B-6. And each content of envelope data corresponds to one of the keys [1] to [0] of the ten-key unit 3B-1. The tone color designation for the third tone color group permits such ten types of tone color control or modulation as illustrated on the bottom stage of the tone color data display section 3B-6, the tone color control or modulation having the following functions when they are briefly explained from the left side of the illustration.

WAH—under which "attack" is carried out two times for a relatively short period of time.

WAIT—under which "attack" is carried out two times for a period of time longer than that for WAH.

ATTACK 5⅓'—under which, at the time of ATTACK, a harmonic of 5⅓-feet is mixed to emphasize the resultant sound to be produced.

ATTACK 4'—under which, at the time of ATTACK, a harmonic of 4-feet is mixed and the resultant tone is emphasized.

DELAYED ATTACK—under which ATTACK is carried out three times for a relatively short period of time.

LONG SUSTAIN—under which the release time succeeding a key-off operation is extended.

TREBLE—under which the harmonic composition selected is added with harmonics of 4-feet and 2-feet.

BASS—under which the harmonic composition selected is added with a 16-feet harmonic.

METALLIC SOUND—under which harmonics of 2⅔, 1 3/5, 1⅓, 1, and 4/5 feet are strongly added to the harmonic composition selected at the time of ATTACK. And, MOD FREE (Modulation Free)—under which no modulation effect is added, with the result that the tone color is determined by the tone color data falling under the preceding two tone color groups.

The designation of these tone color modulations is made by a combined actuation of the modulation switch 3B-4 and one of the keys [1] to [0] of the ten-key unit 3B-1 corresponding to a desired one of the tone color modulation data.

A program/preset switch 3B-5 is a switch for changing the mode of setting the preset tone colors to that of setting program tone colors or vice versa. Under the program tone color setting mode, it is possible to preset into a tone color data memory (see FIG. 4), as will be later described, combined tone color data prepared by designating one tone color from each tone color group through actuating the ten-key unit 3B-1, the feet switch 3B-2, envelope switch 3B-3 and modulation switch 3B-4. Further, the tone color data of the three tone color groups are displayed, on the tone color data display section 3B-6, in the form of a matrix of 3×10 by means of, for example, printing.

In the display section 4, each figure place is comprised of an 8-shaped light emitting diode segment array or liquid crystal display segment array and, for example, a numeric value of three places or figures can be displayed. Accordingly, when the apparatus is kept in the tuning mode of operation, the frequency of, for example, 442 Hz of the tone pitch $A_4$ is displayed. Further, when the tone color setting operation is carried out by combining the tone color data prepared from designating one from each tone color group through the above-mentioned key actuation, the tone color data prepared from the first (FEET), second (ENVELOPE), and third (MODULATION) groups are displayed, by the numeric values of the keys actuated, at the third, second and first figure places, respectively. During the setting operation, the place corresponding to the group subjected to that setting operation provides a flashing display of its contents, thereby informing that group is kept under the setting operation. Also, when the same tone color is set with respect to each key of the keyboard 2, this tone color is numerically displayed only at the first place of the display section 4. Further, when a program tone color is prepared by a combination of the tone color data obtained from the groups the numeric value "0" is displayed in the third place of the display section 4, a bar (—) in the second place thereof, and a memory address which is stored with the program tone color set in the tone color data memory (see FIG. 4) is displayed in the first place.

Figure 4:
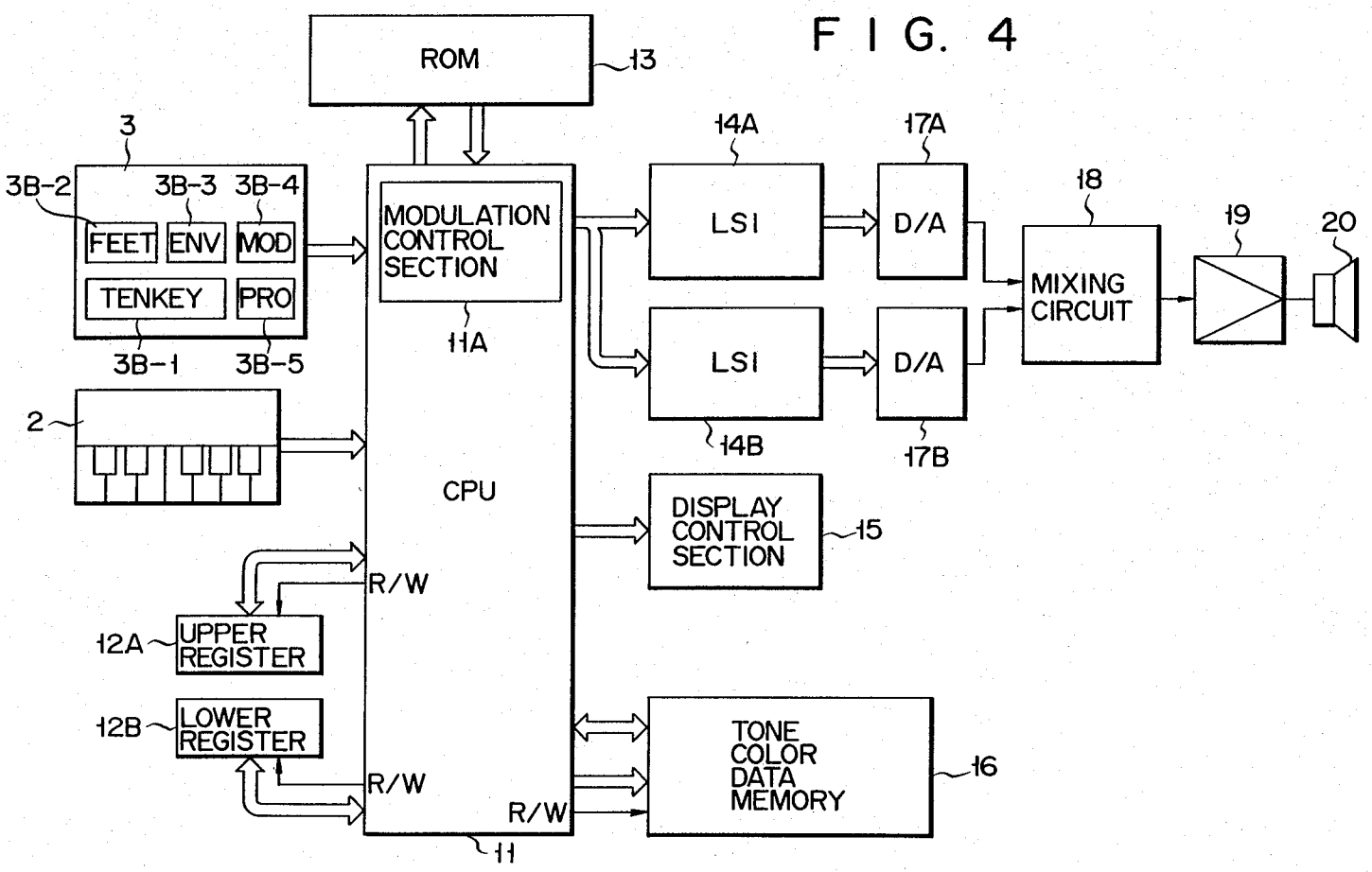
FIG. 4 is a block circuit diagram of the electronic musical instrument of FIG. 1.
Figure 6:
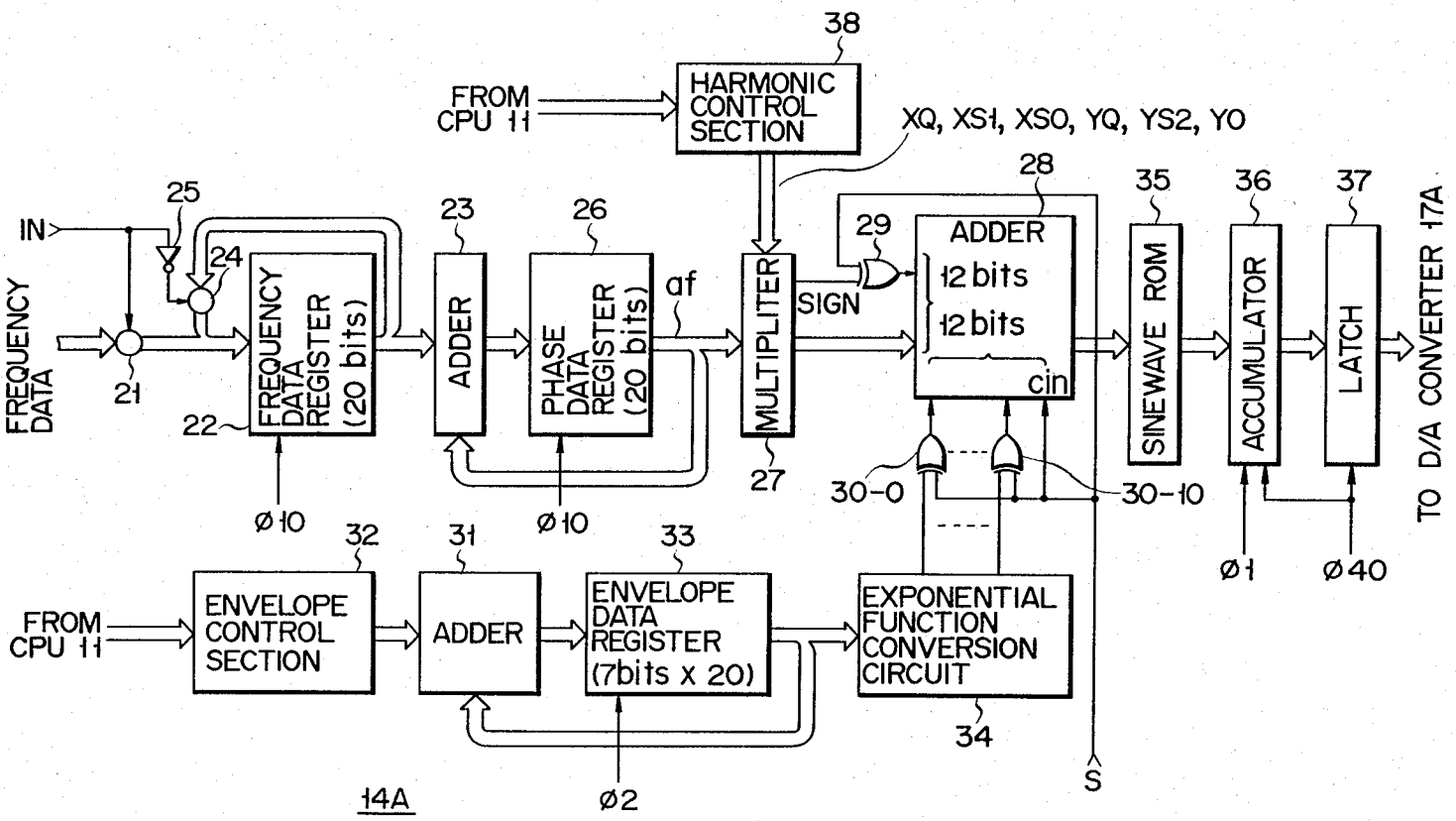
FIG. 6 is a block circuit diagram of an LSI chip of FIG. 4.

Next, the circuit constructions shown in FIGS. 4 and 6 are explained. In FIG. 4, the outputs from the keyboard 2 and switch section 3 are inputted into CPU 11. The CPU 11 is comprised of a microprocessor of, for example, one chip, and is designed to control the entire operation to be performed by the electronic musical instrument. A modulation control section 11A provided within the CPU 11 is provided to convert the tone color modulation data inputted from the above-mentioned third (modulation) group into frequency data and envelope data, thereby to supply a command signal to LSI chips 14A and 14B (later described) used for tone generation. Not only the keyboard 2 and switch section 3 are connected to the CPU 11, but also an upper register 12A, lower register 12B, ROM (Read Only Memory) 13, LSI chips 14A and 14B, display control section 15 and tone color data memory 16 are connected through bus lines.

In the upper register 12A, there are set and stored tone color data made available when the keyboard 2 is not split, as well as tone color data used for the upper keyboard 2 has been split. And, in the lower register 12B, tone color data used for the lower keyboard when the keyboard 2 has been split is stored. Thus, the data reading and writing operation of the upper and lower registers 12A and 12B is controlled in accordance with the read/write signals R/W from the CPU 11.

Figure 3:
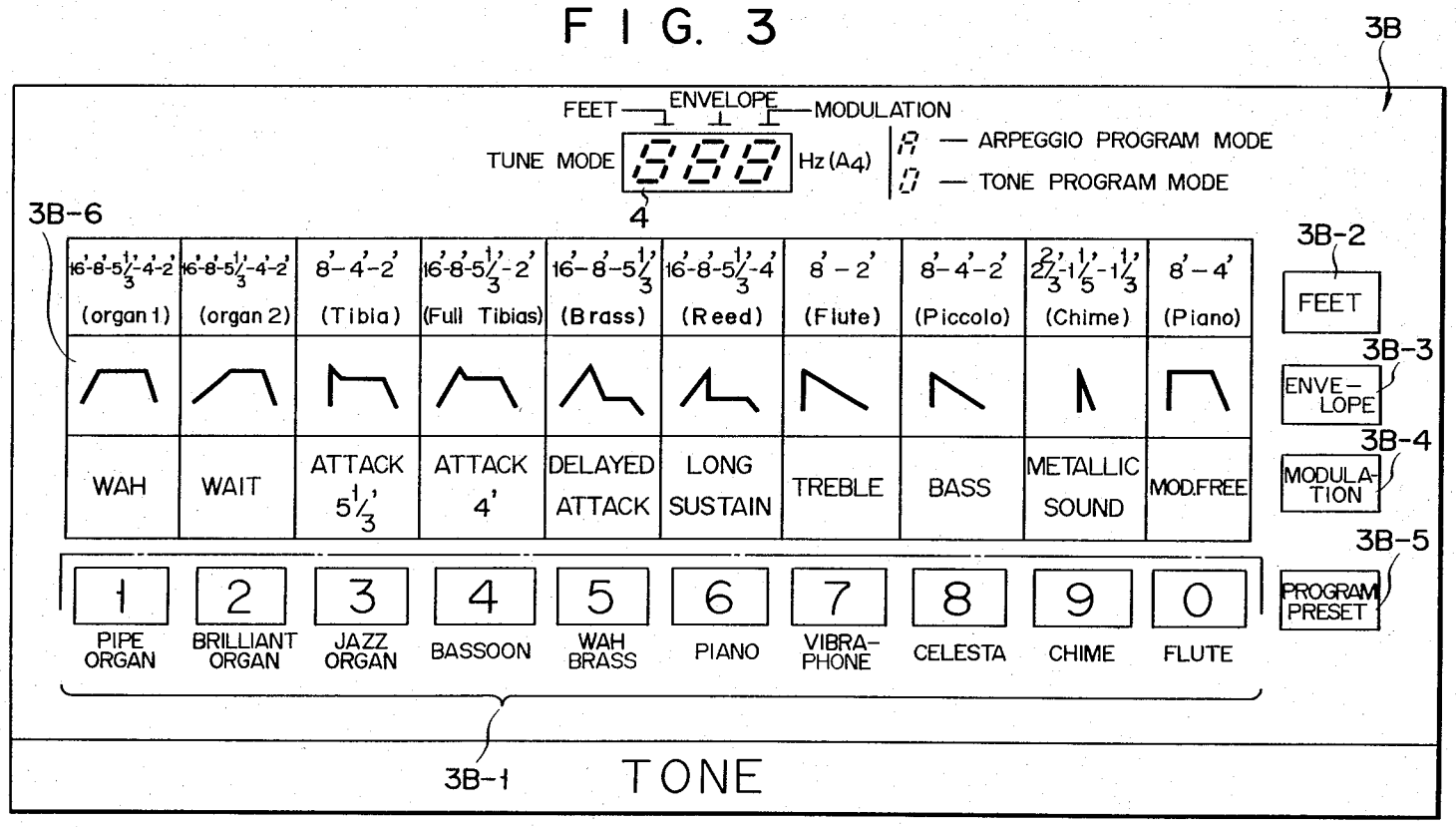
FIG. 3 is an enlarged plan view showing a tone switch section of FIG. 1.

ROM 13 stores the tone color data pieces shown on the tone color data display section 3B-6 of FIG. 3 in such a manner that it maintains a relationship of one-piece to one-piece correspondence with the tone color data display section 3B-6. The construction of ROM 13 is roughly shown in FIG. 5A.

The LSI chips 14A and 14B have the same circuit construction so that each of them may permit a simultaneous production of four musical tones through a 4-channel time divisional processing operation. Their detailed construction will be described later by referring to FIG. 6. Thus, the CPU 11 produces frequency data corresponding to the octave and note of the actuated key on the keyboard 2, envelope data and modulation data, as well as the control data corresponding to the outputs from the switch section 3, and applies these data to the LSI chips 14A and 14B. And the musical tone signals which are produced from the LSI chips 14A and 14B are applied to corresponding D/A converters 17A and 17B, respectively, and are then supplied to a mixing circuit 18 to undergo the mixing operation. The resultant sound is generated from the sound generating section 5 of FIG. 1 through an amplifier 19 and a loud-speaker 20.

The display control section 15 controls the displaying operations of the display section 4 and the display units 3A-6 to 3A-8.

The tone color data memory 16 is comprised of a RAM (Random Access Memory) and is stored with combined numeric data corresponding to the combined tone color data of a program tone color optionally set by actuating the above-mentioned ten-key unit 3B-1, feet switch 3B-2, envelope switch 3B-3, modulation switch 3B-4 and program/preset switch 3B-5. The construction of the tone color data memory 16 is generally shown in FIG. 5B. As shown, it is possible to store ten kinds at maximum of program tone colors into the memory 16. It is to be noted here that the data reading and writing operation of the tone color data memory 16 is controlled in accordance with the read/write signals R/W outputted from CPU 11.

Next, the detailed construction of the LSI chips 14A and 14B is explained by referring to FIG. 6. Since, as mentioned above, the LSI chips 14A and 14B are the same in construction, the construction of the LSI chip 14A will now be explained as being representative of both.

The LSI chip 14A can perform a 4-channel time divisional processing operation. That is to say, in this LSI chip 14A, each channel corresponds to one musical tone and it is possible to prepare a maximum of four musical tones. Accordingly, the shift registers concerned, such as, a frequency data register, etc. (which will be described later) each have four shifting stages corresponding to four channels. Note, however, that, as later described, an envelope data register has twenty shifting stages.

The frequency data corresponding to the octave and note of the actuated key on the keyboard 2 outputted from the CPU 11 and inputted into the LSI chip 14A through the bus line, is applied, through a gate circuit 21, to a frequency data register 22. The frequency data register 22 consists of four cascade-connected shift registers each having a memory capacity of twenty bits, and conducts its shifting operation by being driven by a clock signal $\phi_{10}$ (see FIG. 7). The frequency data outputted from the fourth-stage register of the frequency data register 22 is not only applied to an adder 23 but is also applied to the first-stage shift register of the register unit 22 through a gate circuit 24, that is fed back to the register unit 22. In this case, gate circuit 21 directly receives a control signal IN from the CPU 11, while the gate circuit 24 receives the same through an inverter 25. Thus, both the gate circuits 21, 24 are subjected to control of their opening and closing operation. The control signal IN is a signal which, when the key actuated corresponds to one of the four channels, is outputted from the CPU 11 as a binary logic level "1" signal with a timing peculiar to that channel. At this time, the corresponding frequency data is supplied to the first stage of the register 22 through gate 21. Meanwhile, the gate circuit 24 is closed, and accordingly the feedback data from the fourth-stage register of the register unit 22 is prohibited from being inputted into the first-stage register thereof. During a period of time which persists, thereafter, until actuated key is turned "off" to make the channel inoperative, the control signal IN is outputted as a "0" signal from the CPU 11 with the timing of that channel. As a consequence, the gate circuit 24 is opened to permit the feedback of the frequency data corresponding to the actuated key, thus permitting this frequency data to be held in the frequency data register unit 22 circulatingly.

The adder 23 adds up the frequency data from the frequency data register unit 22 and a phase data fed back from a phase data register 26 (the phase data indicates a phase address), thereby producing a new phase data and applying the same to the phase data register 26. The phase data register 26 consists of four cascade-connected shift registers each having a memory capacity of twenty bits and is driven by a clock signal $\phi_{10}$ (see FIG. 7). The phase data outputted from the fourth-stage register of the phase data register unit 26 is applied to a multiplier 27. This means that the adder 23 and phase data register unit 26 are the circuits which accumulate the frequency data to obtain a phase address af.

The multiplier 27 is supplied with signals XS0, XS1, XQ, Y0, YS2 and YQ outputted from a harmonic control section 38 under the control of the CPU 11. The signals XS0, XS1 and XQ are gate control signals which permit the phase address af, a data obtained by multiplying the phase address af by 2, and a result of the immediately preceding arithmetic operation to be inputted into an X input terminal of an adder built in the multiplier 27. On the other hand, the signals Y0, YS2 and YQ are gate signals which permit the data "0", a data obtained by multiplying the phase data address af, by 2 and a result of the immediately preceding arithmetic operation to be supplied to a Y input terminal of the adder of the multiplier 27. The output data of the multiplier 27 is applied to a first input terminal of an adder 28. The most significant bit of the output data (twelve-bit data) from the multiplier 27 is a SIGN bit which indicates a notation or sign, and which is applied to the adder 28 through an exclusive OR gate 29. Further, envelope data (eleven-bit data) supplied from an exponential function conversion circuit 34 is applied, through exclusive OR gates 30-10 to 30-0 to a second input terminal of the adder 28.

An envelope value data outputted from an evelope control section 32 under the control of the CPU 11 is applied to an adder 31. This envelope value data is a data which, at the time of the "on" or "off" operation of the performance key 2, under the control of CPU 11, is given on the basis of ADSR (ATTACK, DECAY, SUSTAIN, and RELEASE) data previously set by external switches, and which is applied to the adder 31 each time the envelope clock signal is generated within the envelope control section 32.

The data from an envelope data register unit 33 is fed back to the adder 31. The envelope data register unit 33 consists of twenty cascade-connected shift registers, each having a memory capacity of seven bits, and is driven by a clock signal $\phi_2$ (see FIG. 7). The adder 31 adds up the envelope value and the output data of the envelope data register unit 33 to prepare a new envelope data (current value of the envelope data) and apply the same to the envelope data register 33. The output data of the envelope data register 33, that is, envelope data, is also applied to the exponential function conversion circuit 34. The exponential function convension circuit 34 is a circuit for converting the envelope data into a data indicating a variation like that of an exponential function, so that the envelope data inputted thereto may have an ideal envelope waveform wherein the ATTACK portion is an upwardly convex curve; the DECAY portion is a downwardly convex curve; and the RELEASE portion is a downwardly convex curve. The exponential function conversion circuit 34 may utilize a circuit which has already been described in Japanese Patent Application No. 56-36595 corresponding to U.S. patent application Ser. No. 324,466, filed on Nov. 24, 1981, and now U.S. Pat. No. 4,453,440. The envelope data outputted from the exponential function conversion circuit 34 is applied, through the exclusive OR gates 30-10 to 30-0, to the adder 28.

Figure 7:
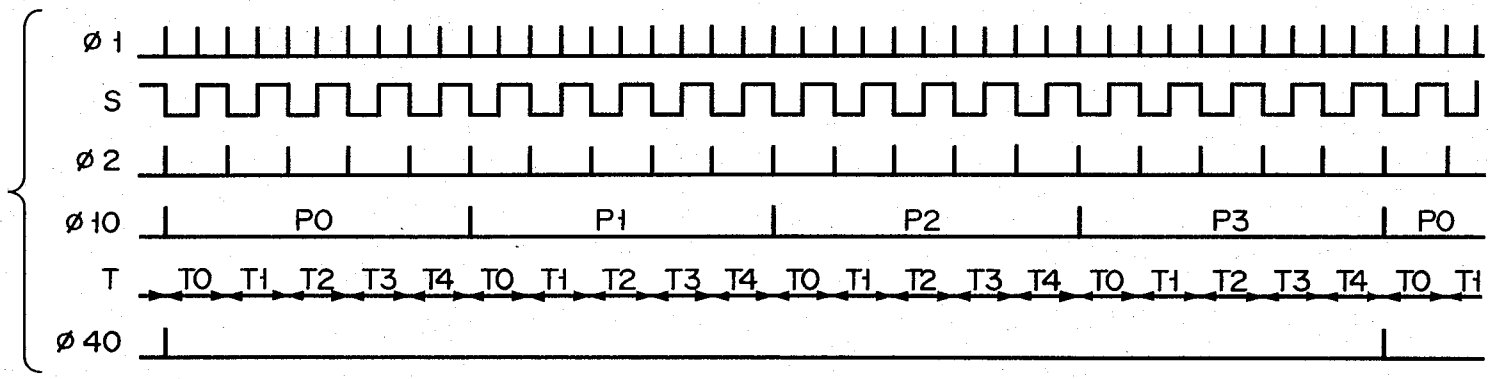
FIG. 7 is a time chart for explaining the operation of the LSI chip of FIG. 6.

The other input terminals of each of exclusive OR gate 29 and exclusive OR gates 30-10 to 30-0 are applied with a signal s which, in response to each system clock $\phi_1$ signal generated, alternately has "1" level and "0" level as shown in FIG. 7. The signal s is also applied to a carry input terminal cin of the adder 28.

Accordingly, when the signal s has a "0" level, the adder 28 adds up the input data to its first input terminal and the input data to its second input terminal to apply the resultant data to a sinewave ROM 35 as an address data. On the other hand, when the signal s has a "1" level, the adder 28 adds up the data from the multiplier 27 of which only the level of the SIGN bit data signal is inverted, and data obtained by expressing the envelope data from the exponential function conversion circuit 34 in the form of the complement of 2, to apply the resultant data to the sinewave ROM section 35. Thus, the sinewave signal read from the adder 28 when the signal s is at the "1" level is the same in frequency and in the amount of phase shift, but opposite in the shifting direction, and reverse in the sign of plus or minus as, the sinewave signal read from the adder 28 when the signal s has a "0" level.

The sinewave ROM section 35 is stored with the amplitude values of the sinewave signal in such a manner as to divide into a $2^n$ number of sampling points (where n is a positive integer, for example, n=12 in this case). And the amplitude value data read from the sinewave ROM section 35 is applied to an accumulator 36, and each time the system clock $\phi_1$ is inputted it is accumulated therein. The accumulated value data of the accumulator 36 is latched in a latch circuit 37 each time a clock signal $\phi_{40}$ is inputted into the accumulator and latch circuit (see FIG. 7). The resultant data is subsequently applied to the D/A converter 17A (see FIG. 4). It is to be noted here that the accumulator 36 has its contents cleared at the times at which the clock signal $\phi_{40}$ is inputted thereinto. Thus, the accumulated value data latched in the latch circuit 37 is a value obtained by accumulating a maximum of forty sinewave signal data.

Next, the tone color data setting operation in the preceding embodiment of the invention will be explained with reference to FIGS. 8 to 10. Firstly, the operation of inputting the tone color data into the tone color data memory 16 will be explained by referring to FIG. 8. When a power switch (not shown) on the switch section 3 is turned on, a display as shown, for example, in FIG. 8(*a*) is made on the display section 4.

This indicates that, at a time preceding the power "on", a tone color data such as the piano (see FIG. 3, the numeric value "6" corresponds to "piano" of the preset tone color) was set on the keyboard 2. It is to be noted here that the data "6 of the preset tone color" is being stored in both the upper register 12A and lower register 12B and, under the control of the display control section 15, is displayed on the display section 4.

Figure 8:
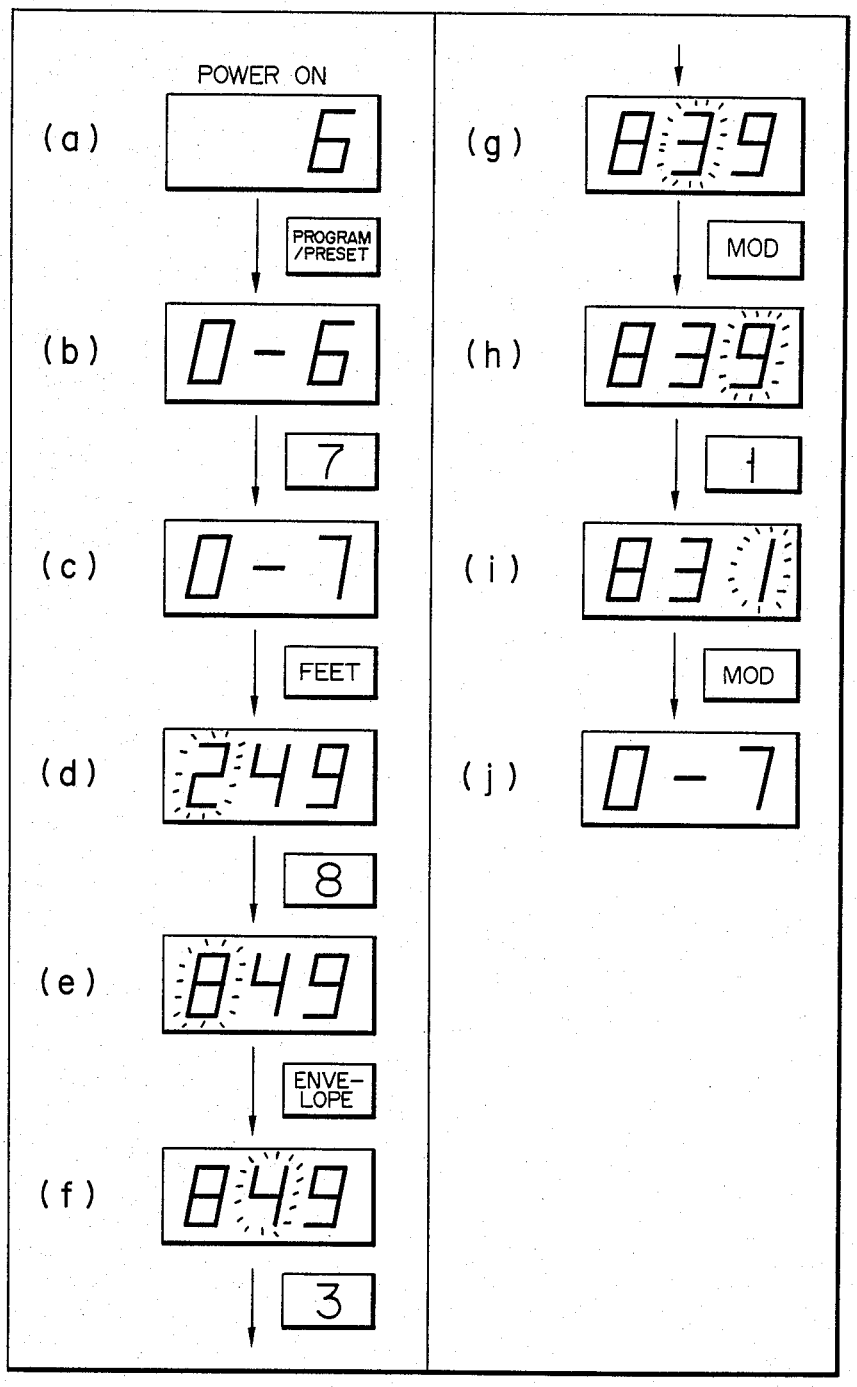
FIGS. 8 to 10 are views for explaining the operation of sequence for setting tone colors, corresponding change of display and tone colors set on a keyboard.

When the program/preset switch 3B-5 is next turned "on", the display control section 15, as shown in FIG. 8(*b*), causes the display section 4 to display "0" and "−", respectively, at its third and second order places as counted from the right of the figure, thus displaying the tone program mode. When it is assumed now that a certain program tone color data is desired to be inputted into, for example, the seventh address of the tone color data memory 16, the key [7] of the ten-key unit 3B-1 is depressed. Thus, the numerical data "7" is displayed at the first order place of the display section 4, as shown in FIG. 8(*c*).

The feet switch 3B-2 is next turned on for inputting the tone color data of the first tone color group. In response to this inputting operation, as shown in FIG. 8(*d*), for example, "249" is displayed on the display section 4, in the form of numerical data, by reading the combined tone color data theretofore set in the seventh address of the tone color data memory 16. In addition, since the input operation for the tone color data of the first tone color group has now been performed by the actuation of the feet switch 3B-2, only the numerical data "2" at the third order place corresponding to the first tone color group, is flashed on the display in accordance with the controlling operation of the display control section 15. When it is now assumed that selection is made of the tone color data having a harmonic configuration of 8′-4′-2′ (piccolo) and the key [8] is turned "on" correspondingly, the numerical data "8" is flashed on the display in the third place of the display section, as shown in FIG. 8(*e*).

When the envelope switch 3B-3 is next turned on, thereby designating the second tone color group, the numerical data "4" of the second place is flashed on the display as shown in FIG. 8(*f*). When it is now assumed that the envelope data corresponding to the key [3] is selected and the key [3] is turned on correspondingly, the numerical data "3" is flashed on the display in the second order place of the display section 4 as shown in FIG. 8(*g*).

The modulation switch 3B-4 is next turned on, thereby designating the third tone color group. In response to this input operation, the content of the first order place starts to be flashed as shown in FIG. 8(*h*). And, when selecting the tone color data (WAH) and turning on the key [1] corresponding to this data (WAH), the numerical data "1" is flashed on the display in the first order place, as shown in FIG. 8(*i*). At this time, the seventh address of the tone color data memory 16 is written with the numerical combined data "831" indicating the program tone color set as mentioned above. When, at this time, the modulation switch 3B-4 is once again actuated to the "on" state, the seventh address of the tone color data memory 16 is displayed on the display section 4 as shown in FIG. 8(*j*). Thus, the setting operation for setting the program tone color represented by FEET: "8", ENV: "3" and MOD: "1" into the seventh address of the tone color data memory 16 is completed. The above setting operation was carried out by inputting the feet data, evelope data and modulation data in the order mentioned, but the present invention is not limited to this input operation but also permits inputting from the tone color data of any tone color group. In any of the resultant cases, by actuating any one of the switches corresponding to the flashing part of the display section, it is possible to complete the inputting of the program tone color data into the address in question. When it is desired to perform the input operation for another address, for example, the second address of the tone color data memory 16, the same operation as mentioned above may be sufficiently carried out after the actuation of the key [2] of the ten-key unit 3B-1. Description thereof is accordingly omitted. Moreover, the same applies to the other memory addresses.

An explanation will now be given for the tone color setting operation directed to setting different tone color data into the upper keyboard and lower keyboard by splitting of the keyboard 2 into two parts, with reference to FIG. 9. In the figure, the set tone colors of the keyboard 2 obtained through the inputting operations performed are shown at the right side of the illustration. First, when the power switch is turned on, the display section 4 at the first order place is displayed, as shown in FIG. 9(*a*), with, for example, the numerical data "2" (this data indicates "BRILLIANT ORGAN" of the preset tone colors) previously stored in the upper register 12A. At this time, the lower register 12B is also storing the data "2 of the preset tone color". Next, the splitting of the keyboard 2 is designated by turning on the split switch 3A-3. AT this time, the numerical data "2" is displayed in the display section 4, as shown in FIG. 9(*b*). When it is now assumed that the piano tone color, for example, of the preset tone colors be set with respect to the upper keyboard, the key [6] of the ten-key unit 3B-1 corresponding to the piano tone color is turned "on", whereby the numerical data "6" is displayed in the first order place of the display section 4 as shown in FIG. 9(*c*), and at the same time the data "6 of the preset tone color" is stored into the upper register 12A. When the tone set switch 3A-2 is subsequently turned on, the data currently stored in the lower register 12B, that is, the data "2 of the preset tone color" representing the BRILLIANT ORGAN" is read out and the numerical data "2" is displayed at the first order place of the display section 4 as shown in FIG. 9(*d*). When it is now assumed that the program tone color set in, for example, the seventh address of the tone color data memory 16 is set, in place of the "BRILLIANT ORGAN", into the lower keyboard, the key [7] is first actuated. Then, the data "7 of the preset tone color" representing "VIBRAPHONE" is written into the lower register 12B and at the same time, as shown in FIG. 9(*e*), the numerical data "7" is displayed in the first order place of the display section 4. When the program/preset button 3B-5 is subsequently actuated or turned "on", display of the program tone mode is made in the display section 4, (the third order place: "0", the second order place: "—", and the first order place: "7") as shown in FIG. 9(*f*). Note here that the numeral "7" of the first order place indicates the address "7" of the tone color data memory 16. Simultaneous with this display, the data "7 of the program tone color" is written into the lower register 12B. Thus, the program tone color represented by the numerical data "831" (FEET: 8, ENV: 3, and MOD: 1) is set into the lower keyboard.

Figure 9:
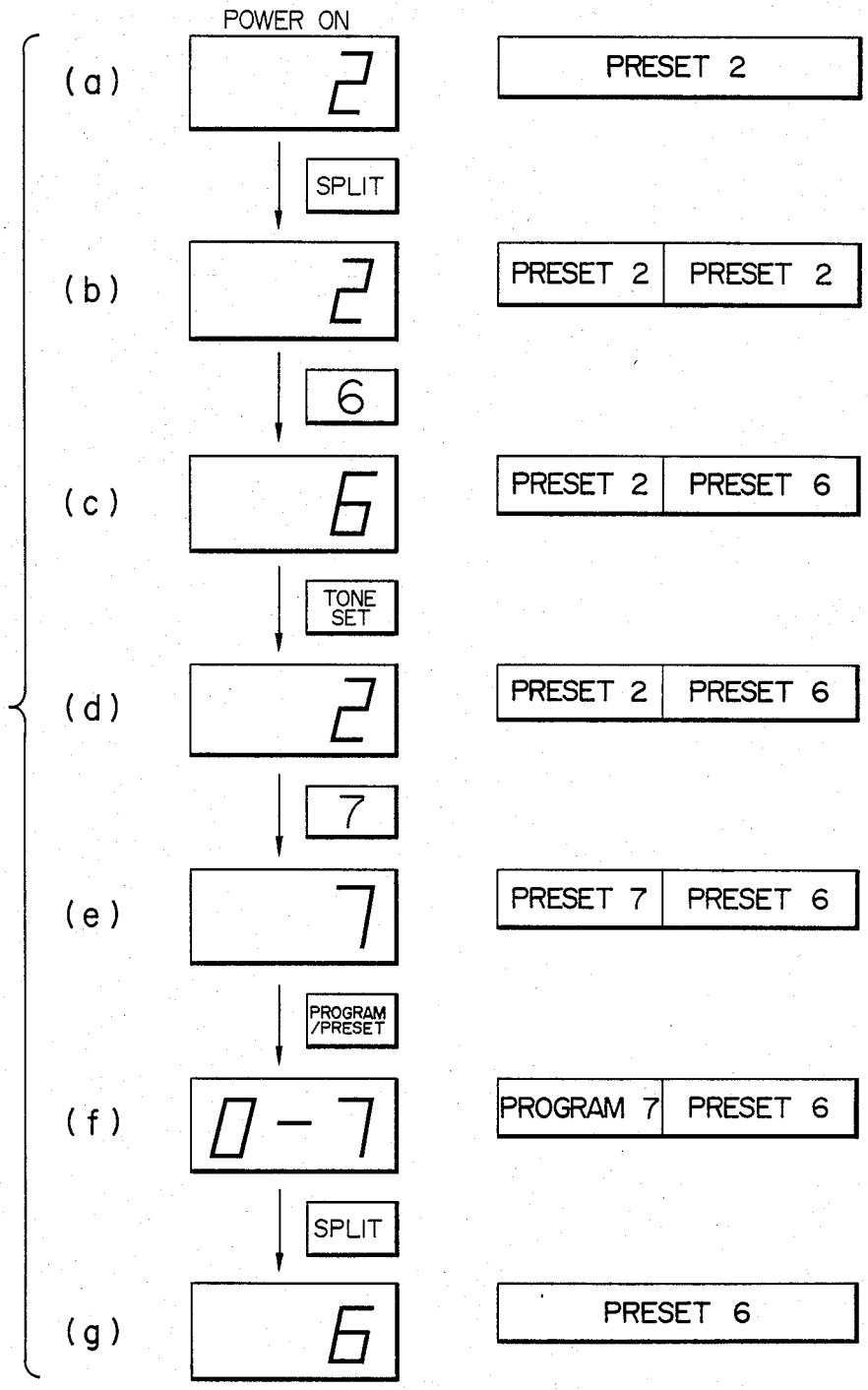
Figure 10:
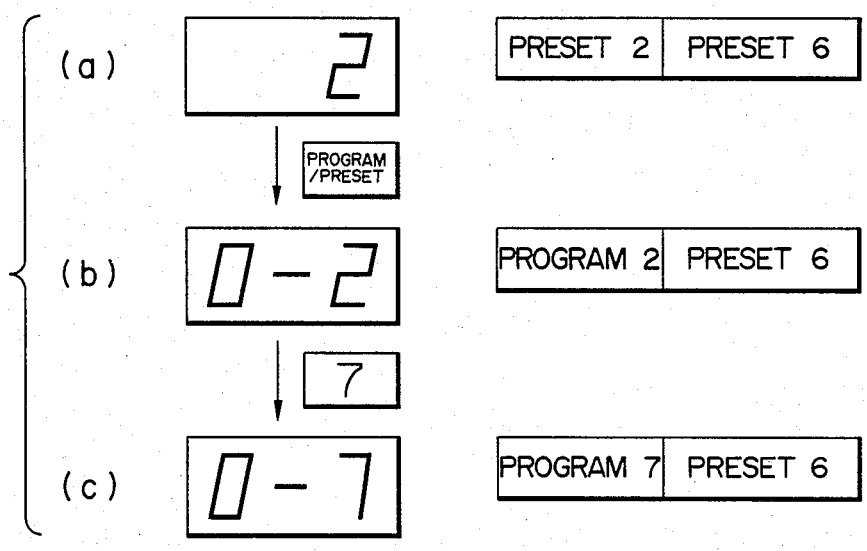

When setting the program tone color stored in the seventh address of the tone color data memory 16 into the lower keyboard, the following setting operation can be carried out instead of executing the setting operation steps of FIGS. 9(*d*) to 9(*f*). That is, when actuating the program/preset switch 3B-5 under the operational state shown in FIG. 9(*d*) (FIG. 10(*a*)), the display section 4 displays the program tone mode (the third order place: 0, the second order place: "—" and the first order place: "2"), as shown in FIG. 10(*b*). Note here that the numerical data "2" in the first order place, as mentioned before, indicates the address number "2" of the tone color data memory 16. Simultaneous with this display operation, the lower register 12B temporarily stores the data "2 of the program tone color" representing the program tone color data already set in the second address of the tone color data memory 16. Upon subsequent actuation of the key [7] as shown in FIG. 10(*c*) and FIG. 9(*f*); the numerical data "2" in the first order place of the display section 4 is changed to "7", thus indicating that the program tone color (for example, the tone color composed of FEET "8", ENV "3" and MOD "1") stored in the seventh address of the tone color data memory 16, has been set into the lower register 12B.

When, the under the operational state thus obtained, musical performance is begun by operating the keyboard 2, the performance keys for the lower two octaves (lower keyboard) permit the performance of the accompaniment based on the use of the program tone color represented by the numerical data code "831", while the performance keys for the upper three octaves (upper keyboard) permit the melody performance using the piano tone color. The detailed operations, in this case, of the LSI chips 14A and 14B, etc. are disclosed in the U.S. Pat. No. 4,453,440. Description thereof, is omitted here in this specification. When the split key 3A-3 is actuated thereafter, the splitting of the keyboard into the upper and lower keyboards is released. At this time, the tone color corresponding to the data "6 of the preset tone color", that is, the piano stored in the upper register 12A, is set for the whole keyboard 2 in preference to the data stored in the lower register 12B. Simultaneously, the numerical data "6" is displayed on the display section 4 in accordance with the contents of the upper register 12A.

In the above-mentioned embodiment, reference was made to the case where the preset tone color is set into the upper keyboard and the program tone color into the lower keyboard. According to the present invention, however, this input arrangement may be reversed, and it is also, of course, possible to set different preset tone colors or program tone colors into the upper and lower keyboards.

Further, the above-mentioned embodiment was arranged so that it is possible to set a total of $10^3 = 1{,}000$ tone colors by preparing ten kinds of tone color data with respect to each of the three tone color groups and combining the tone color data from these groups on an optional basis. But, of course, the number of these tone color groups, the number and kinds of the tone colors with respect to each tone color group, etc. are not limited to the above-mentioned embodiment but may be selected on an optional basis. Further, in the above-mentioned embodiment, the input operation for the tone color data of each tone color groups was carried out by combining the actuating key for each tone color group and the selected key of the ten-key unit. The invention, however, is not limited to this arrangement but permits the provision of an input key with respect to each tone color data of the tone color group.

Further, according to the present invention, it is possible to input the tone color data by providing a $3\times10$ number of touch switches. In this case, as disclosed in U.S. Pat. No. 4,121,204, it is possible to use a transparent touch switch and also to provide display means for displaying the contents of the tone color data inputted from such touch switch, the touch switch being disposed in an overlapping relationship with the display means and in correspondence to the same.

Further, in the above-mentioned embodiment, the tone color data combined of the three tone color group were displayed by the 8 shaped segment arrays in three places, but the present invention is not limited thereto. For example, it is possible to provide a lighting display element with respect to each tone color data of the tone color group. If, in this case, each data is described on a transparent panel, for instance, and is illuminated from inside the panel by being bounded, then it will yield a more effective display effect.

Further, the display devices disposed in overlapping relationship with the touch switches may each be of the self-illuminating type. By so doing, the inputting operation becomes easier, and at the same time the tone color data input by selection can be determined at a glance. These are among the great advantages of the present invention.

The above-mentioned embodiment is applied to a tone color setting apparatus for an electronic musical instrument. The present invention is not limitative thereto and can also be applied to an embodiment wherein tone color is set for executing automatic play of a piece of music by using a personal computer.

As described above, the present invention provides a tone color setting apparatus which is capable of setting, by combining tone color data of tone color groups, a large number of tone colors as compared with the prior art apparatus. This permits very easy performance of the tone color setting operation, particularly by a beginner, so as to permit him to perform music containing various tone colors without difficulty. Further, since the present invention also permits the display of the contents of the set tone color data, it is easy to confirm those contents. All of these advantages are also peculiar to the present invention.

What is claimed is:

1. A tone color setting apparatus comprising:

tone color data memory means including at least first memory means for storing a first tone color group including a plurality of tone color data, and second memory means for storing a second tone color group including a plurality of tone color data different from that of said first tone color group; and tone color setting means coupled to said tone color data memory means for designating a desired one of tone color data from each corresponding tone color group of said at least first and second memory means, and for combining the designated tone color data;

said tone color setting means including tone color group designating means including a number of actuable members for designating the tone color groups and key input means including a plurality of actuable keys each corresponding to a different tone color data selection for the tone color data group designated by said tone color group designating means, the tone color data of each tone color group being designated by actuations of one of the actuable members of said tone color group designating means and one of the keys of said key input means; and wherein a combined tone color is set by said tone color setting means for forming musical tones to be generated from tone generating means.

2. A tone color setting apparatus according to claim 1, wherein said key input means comprises ten actuable keys.

3. A tone color setting apparatus according to claim 1, comprising numerical data display means for displaying numerals designated by operating corresponding keys of said key input means for each of the tone color groups, and for displaying which tone color data is designated in said respective tone color group.

4. A tone color setting apparatus according to claim 1, wherein said tone color setting means comprises touch switches each provided for a corresponding one of said tone color data which belong to said tone color groups, respectively.

5. A tone color setting apparatus according to claim 4, in which said touch switches each include a transparent touch switch, and which further comprises a display means for displaying the content of the tone color data inputted from the transparent touch switch, and the transparent touch switch and said display means are disposed in an overlapping relationship with each other.

6. A tone color setting apparatus according to claim 5, wherein said display means further comprises interior illumination means corresponding to said each tone color data, for indicating by illumination the tone color data of said tone color groups.

7. A tone color setting apparatus according to the preceding claim 1, which further comprises a plurality of memory means for storing therein the tone color data set by said tone color setting means.

8. A tone color setting apparatus according to claim 3, which further comprises a plurality of memory means for storing therein the tone color data set by said tone color setting means.

9. A tone color setting apparatus according to claim 4, which further comprises a plurality of memory means for storing therein the tone color data set by said tone color setting means.

10. A tone color setting apparatus according to claim 5, which further comprises a plurality of memory means for storing therein the tone color data set by said tone color setting means.

11. A tone color setting apparatus according to claim 6, which further comprises a plurality of memory means for storing therein the tone color data set by said tone color setting means.

12. A tone color setting apparatus according to claim 1, wherein said tone color setting means includes a CPU which is coupled to said tone color data memory means, for controlling operations of said tone color setting means to combine the tone color data designated from the tone color groups.

* * * * *

UNITED STATES PATENT AND TRADEMARK OFFICE

CERTIFICATE OF CORRECTION

PATENT NO. : 4,538,495

DATED : September 3, 1985

INVENTOR(S) : Kunio SATO

It is certified that error appears in the above-identified patent and that said Letters Patent is hereby corrected as shown below:

COLUMN 3, line 9, change "groups" to --group--;

COLUMN 3, line 16, change "5 1/3" to --5 1/3'--;

COLUMN 4, line 19, after "one" insert --tone color--;

COLUMN 5, line 46, change "this" to --the--;

COLUMN 11, line 3, change "groups" to --group--;

COLUMN 11, line 19, change "groups" to --group--;

COLUMN 12 (Claim 5), line 32, after "comprises" delete "a".

Signed and Sealed this

*Eleventh* Day of *March 1986*

[SEAL]

*Attest:*

DONALD J. QUIGG

*Attesting Officer*

*Commissioner of Patents and Trademarks*